US009625209B2

(12) United States Patent
Darde et al.

(10) Patent No.: US 9,625,209 B2
(45) Date of Patent: Apr. 18, 2017

(54) METHOD FOR CRYOGENICALLY SEPARATING A MIXTURE OF NITROGEN AND CARBON MONOXIDE

(75) Inventors: Arthur Darde, Paris (FR); Antoine Hernandez, Chatenay Malabry (FR); Bernard Saulnier, La Garenne Colombes (FR)

(73) Assignee: L'Air Liquide Société Anonyme Pour L'Étude Et L'Exploitation Des Procedes Georges Claude, Paris (FR)

( * ) Notice: Subject to any disclaimer, the term of this patent is extended or adjusted under 35 U.S.C. 154(b) by 1338 days.

(21) Appl. No.: 13/511,812

(22) PCT Filed: Nov. 4, 2010

(86) PCT No.: PCT/FR2010/052368

§ 371 (c)(1),
(2), (4) Date: Jul. 5, 2012

(87) PCT Pub. No.: WO2011/067492

PCT Pub. Date: Jun. 9, 2011

(65) Prior Publication Data

US 2012/0279254 A1 Nov. 8, 2012

(30) Foreign Application Priority Data

Nov. 24, 2009 (FR) ..... 09 58305

(51) Int. Cl.
*F25J 3/02* (2006.01)

(52) U.S. Cl.
CPC ..... *F25J 3/0223* (2013.01); *F25J 3/0252* (2013.01); *F25J 3/0257* (2013.01); *F25J 3/0261* (2013.01);

(Continued)

(58) Field of Classification Search
CPC ..... F25J 3/0257; F25J 3/0261; F25J 2205/04; C01B 3/506; C01B 2210/05
See application file for complete search history.

(56) References Cited

U.S. PATENT DOCUMENTS 3,000,188 A * 9/1961 Greco ..... C07C 7/04 62/47.1
4,217,759 A * 8/1980 Shenoy ..... F25J 3/0223 252/373

(Continued)

FOREIGN PATENT DOCUMENTS

DE 2147465 4/1973
DE EP 0313883 A2 * 5/1989 ..... C01B 3/506

(Continued)

OTHER PUBLICATIONS

Berninger, R, Progress in H2/CO Low Temperature Separation, vol. 62, pp. 18-32, Jan. 1, 1988 Linde Reports on Science and Technology.

(Continued)

*Primary Examiner* — John F Pettitt
*Assistant Examiner* — Tareq Alosh
(74) *Attorney, Agent, or Firm* — Justin K. Murray

(57) ABSTRACT

A method for separating a feed gas, containing nitrogen and carbon monoxide as main components, in a distillation column: the feed gas is cooled in a heat exchanger; at least a portion of the feed gas, or at least a portion of a gas derived from the feed gas, is sent to a reboiler of the distillation column so as to condense the gas while producing a liquid, and optionally a gas; at least a portion of the liquid is sent to the distillation column; a nitrogen gas-rich flow is extracted from the distillation column; a carbon monoxide-rich flow is extracted from the distillation column, heated in (Continued)

the heat exchanger, and compressed so as to provide a carbon monoxide-rich material at production pressure.

6 Claims, 3 Drawing Sheets

(52) U.S. Cl.
CPC ..... *F25J 2200/40* (2013.01); *F25J 2200/74* (2013.01); *F25J 2205/04* (2013.01); *F25J 2210/42* (2013.01); *F25J 2270/02* (2013.01); *F25J 2270/04* (2013.01); *F25J 2270/24* (2013.01); *F25J 2270/904* (2013.01); *F25J 2290/34* (2013.01); *F25J 2290/80* (2013.01)

(56) References Cited

U.S. PATENT DOCUMENTS

| | | | | |
|---|---|---|---|---|
| 4,478,621 | A | 10/1984 | Fabian | |
| 5,133,793 | A * | 7/1992 | Billy | F25J 3/0223 62/630 |
| 5,351,491 | A * | 10/1994 | Fabian | F25J 3/0223 62/621 |
| 6,578,377 | B1 * | 6/2003 | Licht | F25J 3/0223 62/620 |
| 2006/0254311 | A1 * | 11/2006 | Billy | C01B 3/506 62/617 |
| 2007/0151291 | A1 | 7/2007 | Fauroux | |
| 2010/0251765 | A1 * | 10/2010 | McNeil | C01B 3/506 62/632 |

FOREIGN PATENT DOCUMENTS

| | | | | |
|---|---|---|---|---|
| DE | 3822175 | | 1/1990 | |
| DE | 4228784 | | 3/1994 | |
| EP | 0979982 | A1 * | 2/2000 | F25J 3/0223 |
| EP | 1215458 | A1 * | 6/2002 | F25J 3/0223 |
| EP | 1278036 | A1 * | 1/2003 | B01D 53/229 |
| EP | 1729077 | | 12/2006 | |
| FR | 2903766 | | 1/2008 | |
| FR | 2910603 | | 6/2008 | |
| FR | 2930332 | | 10/2009 | |
| GB | 1165524 | | 10/1969 | |

OTHER PUBLICATIONS

PCT/FR2010/052368, International Search Report and Written Opinion, Dec. 18, 2013.

* cited by examiner

METHOD FOR CRYOGENICALLY SEPARATING A MIXTURE OF NITROGEN AND CARBON MONOXIDE

CROSS REFERENCE TO RELATED APPLICATIONS

This application is a §371 of International PCT Application PCT/FR2010/052368, filed Nov. 4, 2010, which claims priority to France Patent Application no. 0958305, filed Nov. 24, 2009, the entire contents of which are incorporated herein by reference.

TECHNICAL FIELD OF THE INVENTION

The present invention relates to a process and to a unit for cryogenically separating a mixture of nitrogen and carbon monoxide.

BACKGROUND

The units for producing carbon monoxide and hydrogen may be separated into two parts:

Generation of the syngas (a mixture essentially containing $H_2$, CO, $CH_4$, $CO_2$, Ar and $N_2$). Among the various industrial syngas production processes, the one based on coal gasification appears to be becoming more and more widespread especially in countries that are rich in coal deposits such as China. The process of partial oxidation of natural gas may also prove advantageous for the production of CO alone or with low $H_2$/CO production ratios. Another process is steam reforming.

Purification of the smelts. Found therein are:

a scrubbing unit with a liquid solvent to remove most of the acid gases contained in the syngas;

a unit for purification over adsorbent beds;

a unit for cryogenic separation referred to as a cold box for the production of CO.

In the case of a syngas resulting from a steam reforming furnace, for the production of CO and hydrogen under pressure, the most common cryogenic process is methane scrubbing, the residual methane content in the syngas being compatible with the methane scrubbing process. In certain cases, it is necessary to include a CO/$N_2$ separation column in the cold box, especially when the nitrogen content in the natural gas is not compatible with the purity of the CO product without this CO/$N_2$ column.

A methane scrubbing layout with CO/$N_2$ column is described in FR-A-2910603.

In the case of certain coal gasification processes, the syngas produced is treated in a cold box by partial condensation with no cycle, the content of inert species ($CH_4$, Ar and $N_2$) being very low and compatible with the purity of the CO.

A partial condensation layout without a separation column is described in EP-A-1729077 and in FR-A-2930332.

A partial condensation layout with a CO/$N_2$ column is described in U.S. Pat. No. 4,478,621. The reboiling of the CO/$N_2$ column being provided by a direct feed of CO at medium pressure into the bottom of the column coming from the CO compressor.

DE-A-4228784 and DE-A-2147465 describe processes comprising the features of the preamble of claim 1 that are similar to that of FIG. 1.

According to FIG. 1, a stream of nitrogen and carbon monoxide 1 is cooled in a heat exchanger 3. It is at least partially condensed in a reboiler 5 fed by the bottoms liquid 17 from the column 15. The vaporized liquid 18 is sent back to the column. The at least partially condensed stream is expanded in a valve 7 and sent to a phase separator 9. The liquid 11 from the phase separator and the gas 13 from the phase separator 9 are sent to the column at different or identical heights. The bottoms liquid 21 from the column 15 is expanded in a valve 19 and sent to the overhead condenser 23 forming part of the column 15. A stream of nitrogen is removed as a purge 25 and is heated in the heat exchanger 3. The vaporized carbon monoxide 27 is also heated in the heat exchanger 3 and is compressed in the first stage 29 of a compressor. It is cooled in a cooler 31 by water and then divided into two. The stream 33 is cooled to an intermediate temperature in the heat exchanger 3 in order to form the stream 45 which is sent to the bottom of the column 15. The stream 41 is very partially cooled in the heat exchanger 3, expanded in a turbine 43 and remixed with the stream 27. The rest of the carbon monoxide 35 is compressed to product pressure by the stage 37 of the compressor and cooled by the cooler 31A in order to form the product stream 39. The stage 29 is even smaller since a part of the reboiling is provided by the stream 1.

SUMMARY OF THE INVENTION

In the case where the methane content in the syngas does not enable a methane scrubbing process in the combined production of CO and hydrogen and where the nitrogen content in the syngas is not compatible with the purity of CO without CO/$N_2$ separation, the unit according to an embodiment of the invention is a partial condensation unit including a CO/$N_2$ column with common integrated cycle for the cooling of the syngas and for the CO/$N_2$ separation energy.

In one embodiment, at least one portion of the CO/$N_2$ column reboiling energy is provided by an external reboiler where the feed gas of the CO/$N_2$ column is completely or partially condensed. This makes it possible to reduce the MPCO stream of the cycle compressor and thus to reduce the energy of the compressor by around 15%.

The process layout may include a CO/$N_2$ distillation column alone or else a CO/$N_2$ column with a CO/$CH_4$ column.

Additionally, an embodiment of the invention may also be applied when it is desired to introduce a CO/$N_2$ separation column treating impure CO coming from a cold box that does not comprise a CO/$N_2$ column. Since the nitrogen content in the CO increases over time, it then becomes useful to add a CO/$N_2$ separation step. The new column is then installed in a dedicated cold box that it is necessary to supply with refrigeration and reboiling energy.

According to one subject of the invention, a process is provided for separating a feed gas containing, as main components, nitrogen and carbon monoxide and optionally hydrogen in a distillation column wherein:

i) the feed gas is cooled in a heat exchanger (3);

ii) at least one portion of the feed gas or at least one portion of a gas derived from the feed gas is sent to a bottom reboiler of the distillation column in order to condense it at least partially while producing a liquid and optionally a gas;

iii) at least one portion of the liquid and optionally at least one portion of the gas are sent to the distillation column;

iv) a stream enriched in gaseous nitrogen is withdrawn from the distillation column;

v) a stream enriched in carbon monoxide is withdrawn from the distillation column, it is heated in the heat exchanger, characterized in that the stream enriched in carbon monoxide is compressed in order to provide a product enriched in carbon monoxide at a production pressure, the feed gas is sent, after cooling, into a first phase separator, the liquid from the first phase separator is expanded, the expanded liquid is sent to a second phase separator and at least one portion of the liquid from the second phase separator is vaporized in order to derive the gas to be sent to the reboiler.

Optionally:

a portion of the carbon monoxide is compressed to a pressure less than or equal to the production pressure, it is cooled in the heat exchanger and it is sent to the bottom of the distillation column;

at least one portion of the liquid from the second phase separator is vaporized in the heat exchanger.

According to another aspect of the invention, a unit is provided for separating a feed gas containing, as main components, nitrogen and carbon monoxide and optionally hydrogen, comprising:

i) a distillation column having a bottom reboiler and optionally an overhead condenser;

ii) a heat exchanger;

iii) a compressor;

iv) means for sending the feed gas into the heat exchanger;

v) means for sending at least one portion of the feed gas or at least one portion of a gas derived from the feed gas to the reboiler in order to condense it at least partially while producing a liquid and optionally a gas;

vi) at least some means for sending at least one portion of the liquid and optionally at least one portion of the gas to the distillation column;

vii) means for withdrawing a stream enriched in gaseous nitrogen from the distillation column;

viii) means for withdrawing a stream enriched in carbon monoxide from the distillation column and for sending it to the heat exchanger, characterized in that it comprises means for sending the stream enriched in carbon monoxide to the compressor in order to provide a product enriched in carbon monoxide at a production pressure, a first phase separator (51), a second phase separator, means for sending the cooled feed gas into the first phase separator, an expansion valve for expanding the liquid from the first phase separator, means for sending the expanded liquid into the second phase separator and means for vaporizing at least one portion of the liquid from the second phase separator in order to derive the gas to be sent to the reboiler.

Optionally, the unit can comprise:

means for sending a portion of the stream enriched in carbon monoxide at a pressure less than or equal to the production pressure to the heat exchanger and then to the bottom of the distillation column;

the heat exchanger is connected to the distillation column and to the second phase separator so as to vaporize at least one portion of the liquid from the second separator in order to derive the heating gas of the bottom reboiler;

the distillation column comprises an overhead condenser;

means for sending the bottoms liquid from the distillation column to the overhead condenser;

means for sending the vaporized bottoms liquid to the compressor.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

Figure 1:
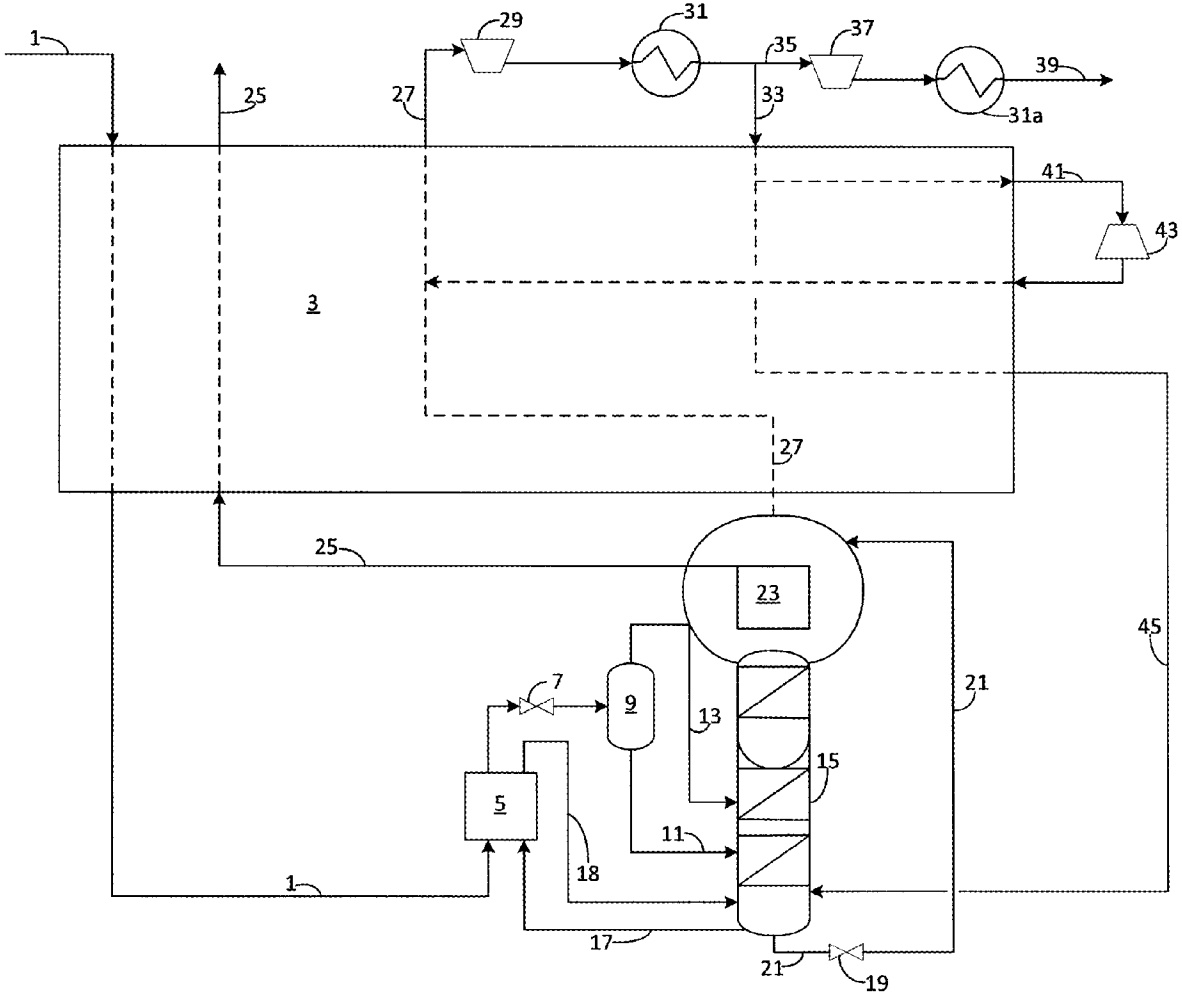
FIG. 1 (Prior Art)
FIG. 1 represents a unit in accordance with the prior art.

The invention will be described in greater detail while referring to the figures which represent a unit substantially according to the prior art for separating a gas having, as main components, nitrogen and carbon monoxide for FIG. 1 and a unit according to the invention for separating a gas having, as main components, nitrogen, hydrogen and carbon monoxide for FIGS. 2 and 3.

Figure 2:
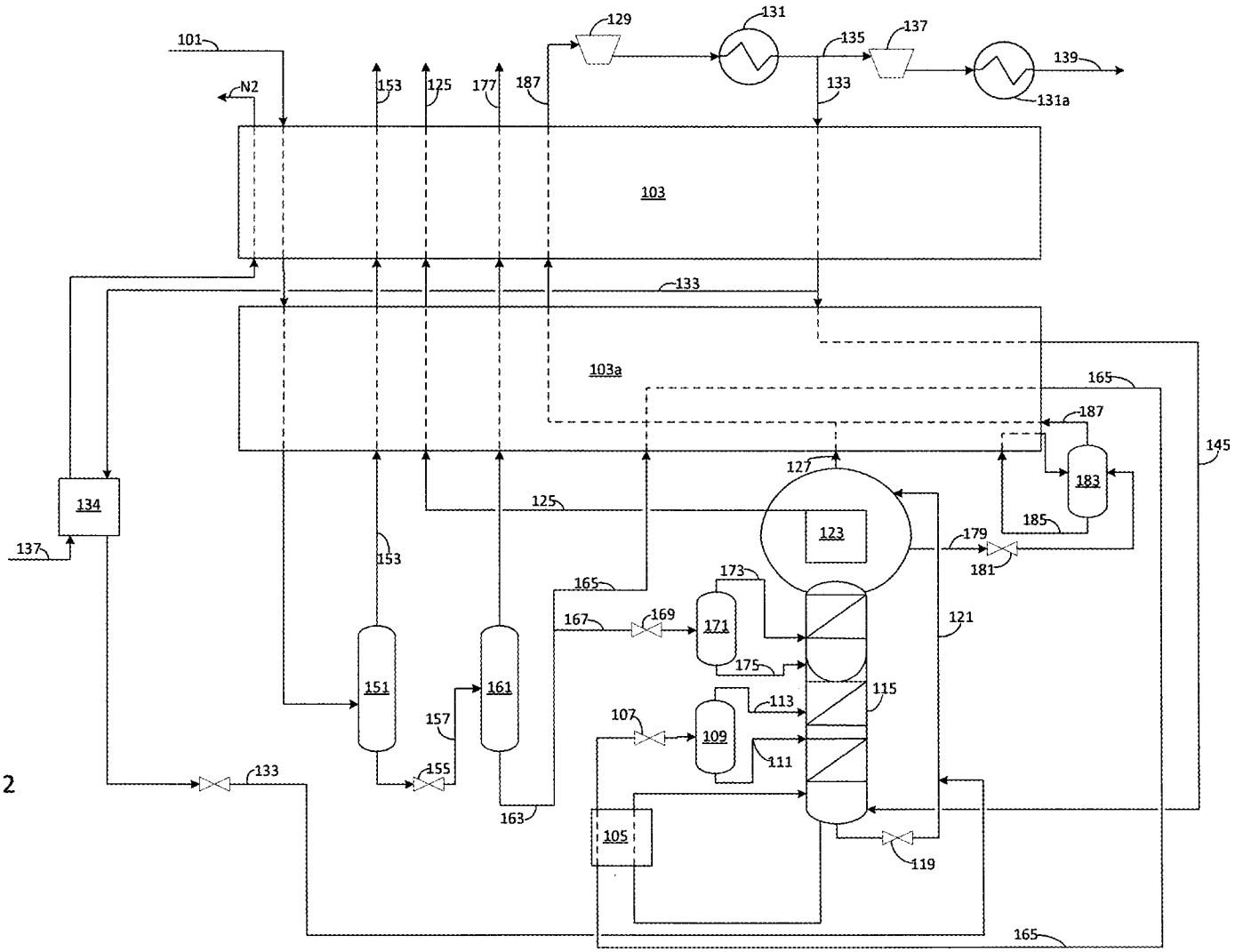
FIG. 2 represents a unit in accordance with an embodiment of the invention.

According to FIG. 2, a stream of nitrogen, hydrogen and carbon monoxide 101 is cooled in a heat exchanger 103 and then in a heat exchanger 103A. The stream 101 is sent to a first phase separator 151 where it is separated into a hydrogen-rich gas stream 153 and a liquid stream 157. The stream 153 is heated in the heat exchangers 103, 103A and the stream 157 is expanded in a valve 155 and then sent to a second phase separator 161. The gas from the second phase separator is heated in the heat exchangers 103, 103A in order to form the stream 177. The liquid 163 is separated into two. One portion 167 is expanded in a valve 169, sent to a third phase separator 171 and then the streams formed 173, 175 are sent to the distillation column 115. The rest 165 of the liquid from the separator 161 is heated in the heat exchanger 103A in order to form the stream 165 which is used to heat the reboiler 105 fed by the bottoms liquid 117 from the distillation column 115. Having been used to reboil the distillation column 115, the stream 165 is expanded in the valve 107, sent to the fourth separator 109 and then to the distillation column 115 in the same way as for FIG. 1.

A stream of nitrogen is removed as a purge 125 and is heated in the heat exchanger 103. The vaporized carbon monoxide 127 is also heated in the heat exchanger 103 and is compressed in the first stage 129 of a compressor. It is cooled in a cooler 131 by water and then divided into two. The stream 133 is cooled to an intermediate temperature in the heat exchanger 103 and is divided into two in order to form the stream 133. This stream 133 is cooled in the heat exchanger 134 against liquid nitrogen 137. The liquid nitrogen 137 is vaporized and heated in the heat exchanger 103. The stream 133 is expanded and mixed with the stream 21 downstream of the valve 119. The stream 145 which is sent to the bottom of the distillation column 15 after cooling in the heat exchanger 103A.

Liquid carbon monoxide 179 is withdrawn from the condenser 123, expanded in the valve 181, sent to the fifth phase separator 183 in order to produce a liquid portion 185 and a gaseous portion 187. The liquid portion is vaporized in the exchange line 103A and the gas 187 is mixed with the carbon monoxide stream 127 intended for the compressor 129.

Figure 3:
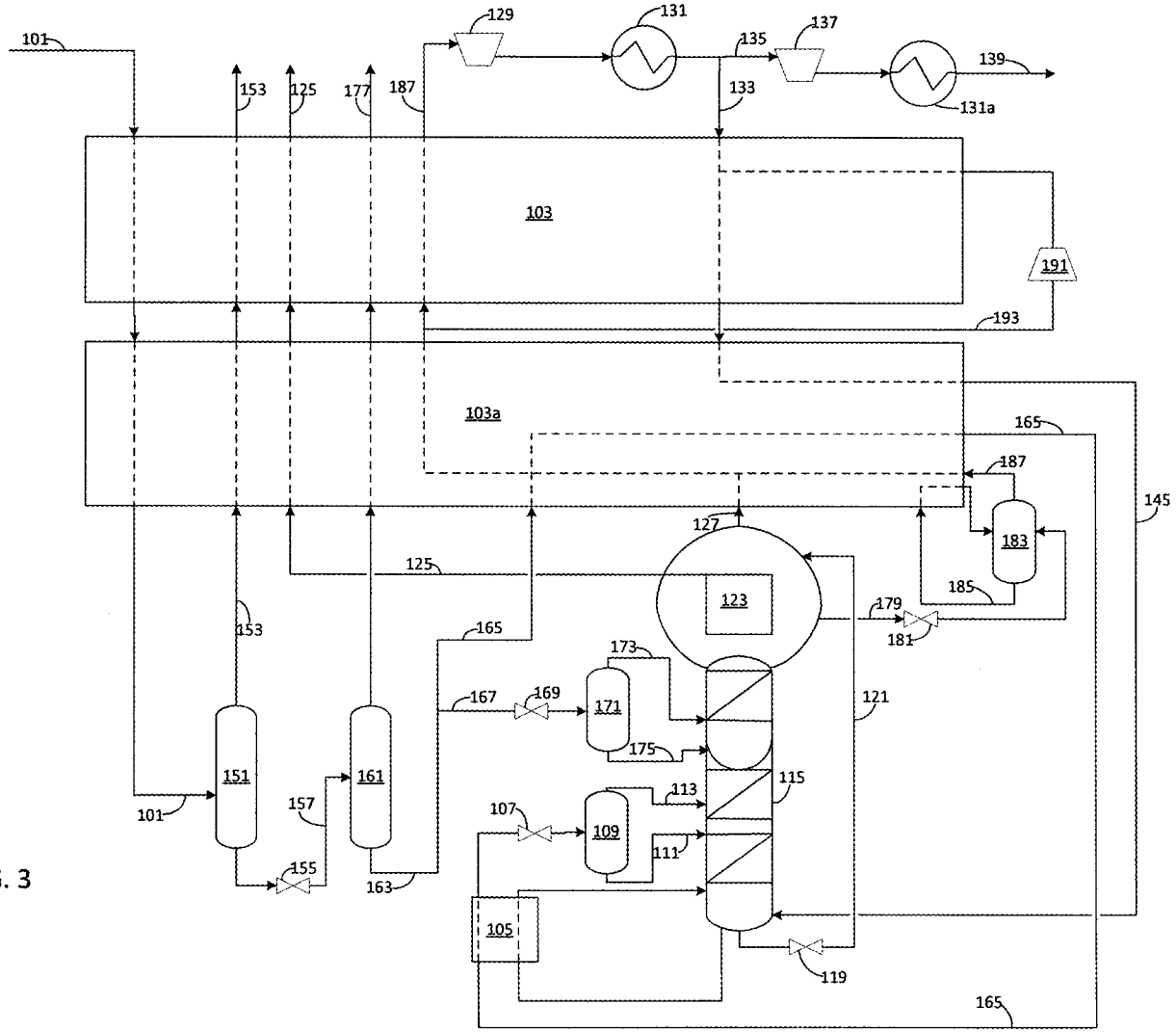
FIG. 3 represents a unit in accordance with an embodiment of the invention.

According to FIG. 3, a stream of nitrogen, hydrogen and carbon monoxide 101 is cooled in a heat exchanger 103 and then in a heat exchanger 103A. The stream 101 is sent to a first phase separator 151 where it is separated into a hydrogen-rich gas stream 153 and a liquid stream 157. The stream 153 is heated in the heat exchangers 103, 103A and the stream 157 is expanded in a valve 155 and then sent to a second phase separator 161. The gas from the second phase separator is heated in the heat exchangers 103, 103A in order to form the stream 177. The liquid 163 is separated into two. One portion 167 is expanded in a valve 169, sent to a third phase separator 171 and then the streams formed 173, 175 are sent to the distillation column 115. The remainder 165 of the liquid from the separator 161 is heated in the heat exchanger 103A to form the stream 165 which is used to heat the reboiler 105 fed by the bottoms liquid 117 from the distillation column 115. Having been used to reboil the distillation column, the stream 165 is expanded in the valve 107, sent to the fourth separator 109 and then to the distillation column in the same manner as for FIG. 1.

A stream of nitrogen is removed as a purge 125 and is heated in the heat exchanger 103. The vaporized carbon monoxide-enriched stream 127 is also heated in the heat exchanger 103 and is compressed in the first stage 129 of a compressor. It is cooled in a cooler 131 by water and then divided into two. The stream 133 is cooled to an intermediate temperature in the heat exchanger 103 and is divided into two in order to form the stream 193. This stream 193 is expanded in the turbine 191 in order to form the expanded stream 193 which is mixed with the stream 127 in order to be heated in the heat exchanger 103. The stream 145 originating from the stage 129 is sent to the bottom of the distillation column 115 after cooling in the heat exchanger 103A.

Liquid carbon monoxide 179 is withdrawn from the condenser 123, expanded in the valve 181, sent to the fifth phase separator 183 in order to produce a liquid portion 185 and a gaseous portion 187. The liquid portion is vaporized in the exchange line 103A and the gas 187 is mixed with the carbon monoxide stream 127 intended for the compressor 129.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

The invention claimed is:

1. A process for separating a feed gas containing, as main components, nitrogen and carbon monoxide and optionally hydrogen in a distillation column wherein:

i) the feed gas is cooled in a heat exchanger;

ii) at least one portion of the feed gas or at least one portion of a gas derived from the feed gas is sent to a bottom reboiler of the distillation column in order to condense at least partially the feed gas or the at least one portion of the gas derived from the feed gas while producing a liquid and optionally a gas;

iii) at least one portion of the liquid and optionally at least one portion of the gas are sent to the distillation column;

iv) a stream enriched in gaseous nitrogen is withdrawn from the distillation column; and v) a stream enriched in carbon monoxide is withdrawn from the distillation column and is heated in the heat exchanger, wherein the stream enriched in carbon monoxide is compressed in order to provide a product enriched in carbon monoxide at a production pressure, the feed gas is sent, after cooling, into a first phase separator, the liquid from the first phase separator is expanded, the expanded liquid is sent to a second phase separator and at least one portion of the liquid from the second phase separator is vaporized against a portion of the compressed stream enriched in carbon monoxide in order to derive the gas to be sent to the bottom reboiler.

2. The process as claimed in claim 1, wherein a portion of the carbon monoxide is compressed to a pressure less than or equal to the production pressure, and is then cooled in the heat exchanger and sent to the bottom of the distillation column.

3. The process as claimed in claim 1, wherein at least one portion of the liquid from the second phase separator is vaporized in the heat exchanger.

4. A process for separating a feed gas comprising nitrogen and carbon monoxide, the process comprising the steps of:

cooling the feed gas to form a cooled feed gas;

separating the cooled feed gas into a first gas and a first liquid using a first phase separator;

expanding the first liquid across a first valve to form an expanded liquid;

separating the expanded liquid into a second gas and a second liquid using a second phase separator;

heating a first portion of the second liquid to form a vaporized second liquid;

at least partially condensing the vaporized second liquid in a bottom reboiler of a distillation column to form a condensed vaporized second liquid;

introducing the condensed vaporized second liquid to the distillation column;

withdrawing a stream enriched in gaseous nitrogen from the distillation column;

withdrawing a stream enriched in carbon monoxide from the distillation column;

heating the stream enriched in carbon monoxide; and compressing the stream enriched in carbon monoxide to provide a product enriched in carbon monoxide at a production pressure, wherein the heating of the first portion of the second liquid is performed against a portion of the compressed stream enriched in carbon monoxide to form the vaporized second liquid.

5. The process as claimed in claim 4 further comprising the step of introducing a portion of the product enriched in carbon monoxide to the bottom of the distillation column after cooling the portion of the product enriched in carbon monoxide.

6. The process as claimed in claim 4 further comprising the steps of:

expanding a second portion of the second liquid to form an expanded second portion; and introducing the expanded second portion to the distillation column.

* * * * *